US006860814B2

(12) United States Patent
Cole

(10) Patent No.: US 6,860,814 B2
(45) **Date of Patent: *Mar. 1, 2005**

(54) GAMING APPARATUS HAVING DOOR MOUNTED DISPLAY

(75) Inventor: Joseph Cole, Las Vegas, NV (US)

(73) Assignee: Patent Rights Protection Group, LLC, Las Vegas, NV (US)

( * ) Notice: Subject to any disclaimer, the term of this patent is extended or adjusted under 35 U.S.C. 154(b) by 9 days.

This patent is subject to a terminal disclaimer.

(21) Appl. No.: 10/253,151

(22) Filed: Sep. 23, 2002

(65) Prior Publication Data

US 2003/0027627 A1 Feb. 6, 2003

Related U.S. Application Data

(63) Continuation of application No. 09/517,642, filed on Mar. 3, 2000, now Pat. No. 6,475,087.

(51) Int. Cl.[7] ..... A63F 11/00

(52) U.S. Cl. ..... 463/46; 463/16; 463/20; 273/138.1; 273/143 R; 273/459; 273/148 R

(58) Field of Search ..... 463/16, 20, 46, 463/47, 34; 273/143, 138.1, 138.2, 459, 148 R, 148 B, 138 B, 138, 121 B; 248/917, 918, 558, 545, 546, 547; 312/223.1; 194/350, 351

(56) References Cited

U.S. PATENT DOCUMENTS

| | | | | |
|---|---|---|---|---|
| 4,084,194 A | | 4/1978 | Hector | |
| 4,363,486 A | * | 12/1982 | Chaudhry et al. | 273/143 B |
| 4,440,457 A | | 4/1984 | Fogelman et al. | |
| 5,509,655 A | * | 4/1996 | Ugawa | 273/121 B |
| 6,164,645 A | | 12/2000 | Weiss | |
| 6,201,703 B1 | | 3/2001 | Yamada et al. | |

FOREIGN PATENT DOCUMENTS

| | | | | |
|---|---|---|---|---|
| JP | 05-068745 | * | 3/1993 | A63F/7/02 |
| JP | 10-052525 | * | 2/1998 | A63F/5/04 |
| JP | 11-239659 | * | 9/1999 | A63F/7/02 |

* cited by examiner

*Primary Examiner*—Xuan M. Thai
*Assistant Examiner*—Yveste Cherubin
(74) *Attorney, Agent, or Firm*—Weide & Miller, Ltd.

(57) ABSTRACT

A gaming apparatus for presenting a wager-type game comprises a cabinet and a door connected to the cabinet, the door moveable between a first position and a second position. In its first position, the door cooperates with the cabinet to define a generally closed interior space. In its second position, the door permits access to the interior space. The door has an opening therein. A relatively thin video display is mounted to an inside of the door in alignment with the opening therein. The use of the video display and its mounting permits the depth of the cabinet to be substantially reduced. In one embodiment, the width of the cabinet exceeds its depth.

14 Claims, 4 Drawing Sheets

20
30
28
22
34
24
66
64
53
50
68
75
51
74
33
62

GAMING APPARATUS HAVING DOOR MOUNTED DISPLAY

RELATED APPLICATION DATA

This application is a continuation of U.S. application Ser. No. 09/517,642, filed Mar. 3, 2000, now U.S. Pat. No. 6,475,087.

FIELD OF THE INVENTION

The present invention relates to gaming devices.

BACKGROUND OF THE INVENTION

A wide variety of devices are known for implementing games of skill and/or chance. There are two very common types of gaming devices. A first type of device is the mechanical type slot machine. These machines comprise a cabinet including one or more mechanical reels and associated controls, such as mechanisms for causing the reels to rotate and stop, coin or other monetary acceptors, and a coin dispenser. In use, a user places a bet, such as with one or more coins. Upon instruction, such as by activation of a "spin" button or handle, the machine effects a spin of the reels. If the event the reels stop in a position displaying a predetermined combination of symbols, the player may be paid winnings based on their bet.

A second type of gaming device is the video gaming device. Such devices comprise a cabinet including a cathode ray tube (CRT) for displaying information. A control in the form of hardware and/or software is provided for playing a game, including displaying information on the CRT. For example, in the game known as video poker, the control causes cards to be displayed on the screen, along with other game play information such as bet information. These cabinets are generally very large and heavy. The CRT is supported on a shelf in a main portion of the cabinet and viewable through a opening in the door.

In order to accommodate the substantial differences between the gaming devices adapted to present these games, these gaming devices are currently manufactured as separate and distinct devices. In other words, a manufacturer custom designs one particular device to be configured as a video gaming device, and custom designs another particular device to be a mechanical reel type device.

There are a number of problems with these gaming devices as currently designed. One problem is that the cost of each individual gaming device is high because it has few features which are common to any other gaming device. The components of each device are unique, generally being designed and manufactured separately. In addition, the assembly of each type of device is then different. The cost of producing numerous different parts and the training and time necessary to assemble the different devices raises the cost of the device.

Another problem with these devices is that they are large and heavy. CRT based video gaming devices are very large because they must accommodate the CRT. A CRT used in a gaming device may be 10–20 inches deep, thus necessitating that the gaming device be at least as deep. In addition, because of heat and an electromagnetic field generated by these CRT's, the cabinet of the gaming device must be sufficiently large to permit adequate ventilation and to permit positioning of other components away from the heat generating CRT.

The size of a gaming device is extremely important. In a gaming establishment, gaming revenue is related to the number of gaming devices which can be arranged into the establishment's floor space. This is especially true of river boat casinos, where space is at an extreme premium. The larger the gaming device, the fewer the number of devices which the establishment can operate. When the number of devices is reduced, so is the revenue associated therewith.

Another problem with these devices is that they are costly to maintain. Because each gaming device is different, unique parts must be obtained in order to repair a particular machine. This either requires extensive training for service personnel regarding the configurations of the many different devices, or requires that the service personnel spend additional time when servicing each machine in order to become familiar with it during a service call.

An improved gaming device is desired.

SUMMARY OF THE INVENTION

A gaming apparatus and methods of configuring the apparatus are disclosed. In general, the gaming apparatus comprises a device which is readily configured to present one of several different games.

In one or more embodiments, the gaming apparatus comprises a cabinet and a door moveable between a first position and a second position. In its first position, the door cooperates with the cabinet to define a generally closed interior space. In its second position, the door permits access to the interior space. The door has an opening therein. At least one mount is provided for mounting a member to the door for viewing through the door opening, the member comprising either a reel-screening panel or a video display, the opening aligned with a reel mechanism when a reel mechanism is mounted to the cabinet and the reel-screening panel is mounted to the door, whereby the reels are viewable through the reel-screening glass when the door is in its closed position, and whereby when a video display is mounted to the door the video display is viewable through the opening.

In accordance with one or more embodiments of the invention, the display comprises a liquid crystal or similar relatively flat and thin display. When configured as a video game, the display is mounted to a back side of the door for viewing through the opening in the door.

In accordance with one or more embodiments of the invention, the cabinet includes at least one mount for supporting one or more reels in a position in which they are viewable through the panel connected to the door.

One or more embodiments of the invention comprise a method of configuring a base configuration of the gaming apparatus to implement or present a particular game. In accordance with the method, the base configuration may be configured to present a reel-type slot game by installing the screening panel to the door and one or more reels to the cabinet for viewing through the panel. In accordance with the method, the base configuration may be configured to present a video type game by connecting the video display to the door. In one or more embodiments, the configuration of the gaming apparatus may be changed to present one game instead of another after first configured to present a specific game.

One embodiment of the invention comprises a gaming apparatus having a substantially reduced depth dimension. In this embodiment, the gaming apparatus includes a cabinet having a pair of opposing sides and a front and a back. A door is connected to the gaming apparatus, the door movable between a first position in which it extends over at least a portion of the front of the cabinet and cooperates with the cabinet to define a generally enclosed interior, and a second position in which access to the interior is permitted. A relatively thin video display is mounted to an inside surface of the door. A gaming controller is preferably mounted in the interior space of the cabinet and is configured to provide data to the video display for displaying game information. In this configuration, the cabinet has a reduced depth dimension. In a preferred embodiment, the depth of the cabinet from front to back is less that the width of the cabinet from side-to-side.

Further objects, features, and advantages of the present invention over the prior art will become apparent from the detailed description of the drawings which follows, when considered with the attached figures.

DETAILED DESCRIPTION OF THE INVENTION

The present invention is a gaming apparatus. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
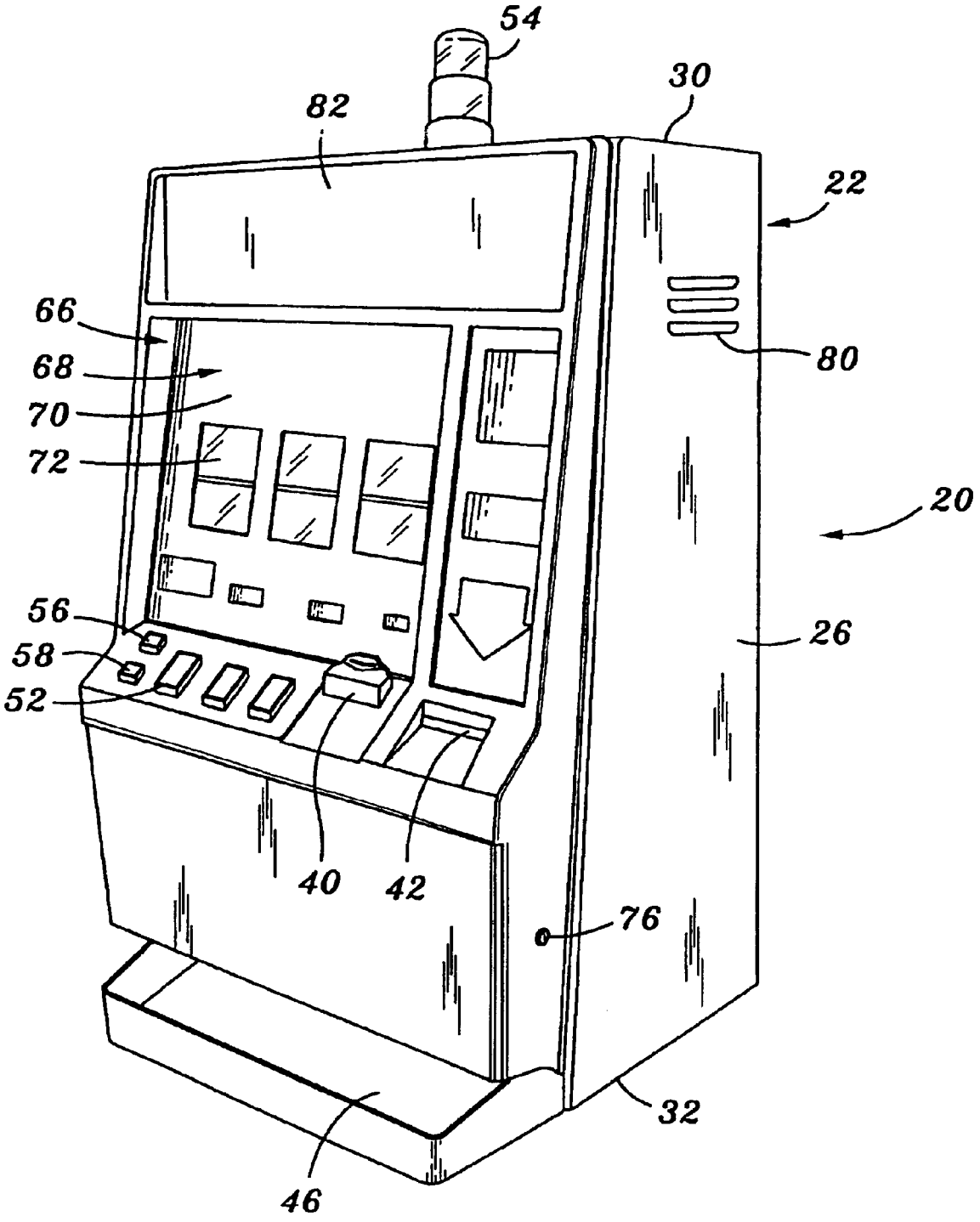
FIG. 1 is a perspective view of a gaming device in accordance with the present invention arranged in a first configuration.

In general, one aspect of the invention comprises a gaming device which is adaptable to implement different types of games. In one or more embodiments there is provided a gaming device which may be readily configured either as a "video" type gaming device (FIG. 4) or a mechanical "reel" type gaming device (FIG. 1). A second aspect of the invention is a gaming device which is compact and consumes minimal space. A third aspect of the invention is a video type gaming device which utilizes a light-weight and thin door-mounted display.

Figure 2:
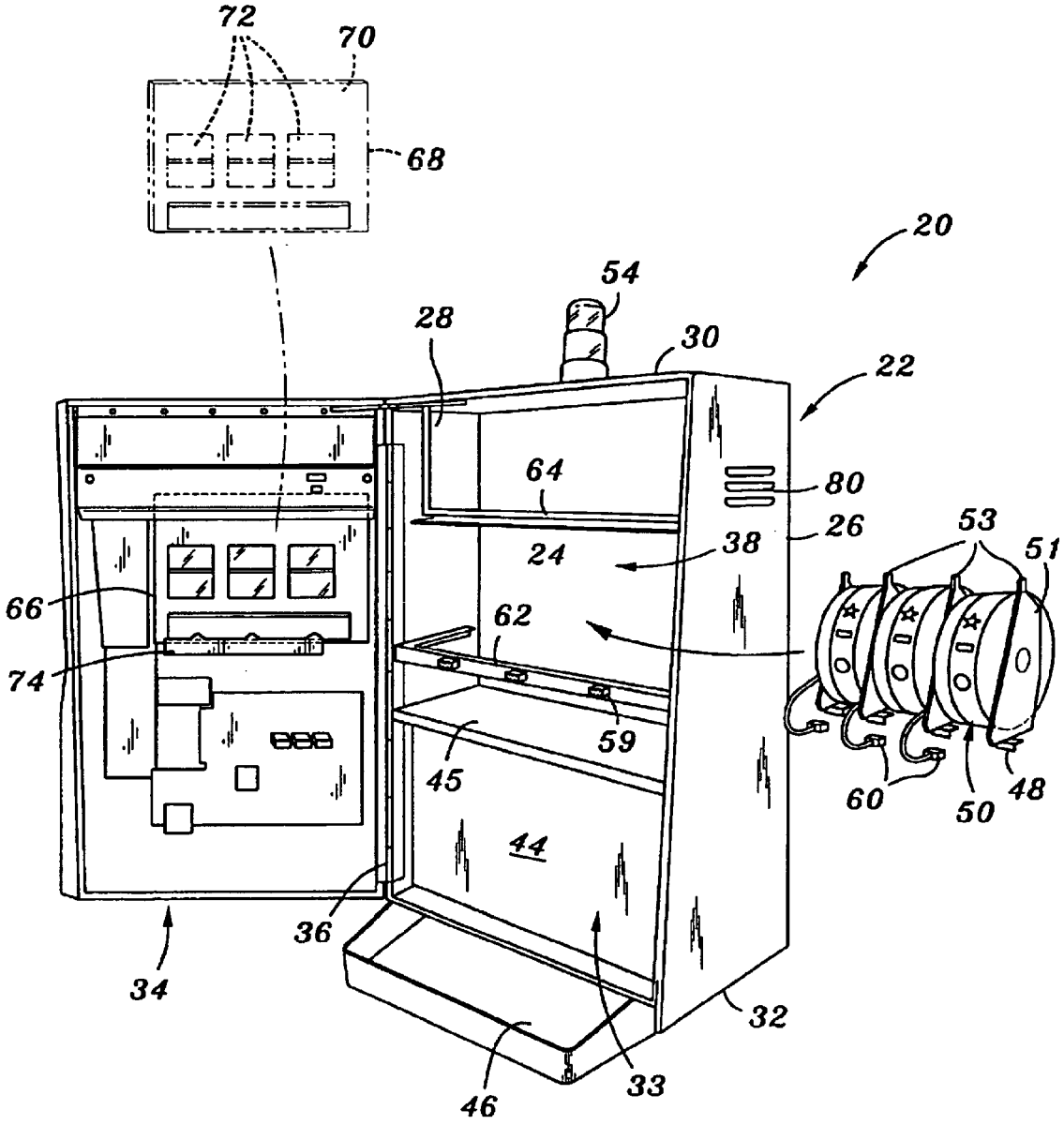
FIG. 2 is a perspective view of the gaming device illustrated in FIG. 1 with a door thereof in an open position and certain components thereof illustrated removed from the device.

An embodiment of a gaming device or apparatus 20 in accordance with the present invention arranged in a first configuration will now be described in detail with reference to FIGS. 1–3. The gaming device 20 of the invention includes a housing or cabinet 22. As best illustrated in FIG. 2, the cabinet 22 has a back 24, opposing first and second sides 26,28, a top 30, and a bottom 32. The cabinet 22 may have a wide variety of configurations and shapes and be constructed of a wide variety of materials. For example, the back, sides, top and bottom of the cabinet 22 may be constructed of stamped metal and powder paint coated.

The cabinet 22 has a front 33 which is located opposite the back 24. A front edge of the first and second sides 26,28, the top 30 and bottom 32 generally define the front 33 of the cabinet 22. As illustrated, the front 33 of the cabinet 22 is generally open.

In one or more embodiments, the distance from the front 33 to the back 24 of the cabinet 22 is less at the top 30 than at the bottom 32. In a preferred embodiment, the depth of the cabinet 22 (i.e. distance from front to back) at the top 30 is in the range of about 12–18 inches or less, while the depth of the cabinet 22 at the bottom 32 (including a coin tray, as disclosed below) is in the range of about 19–26 inches. As illustrated, in a preferred embodiment, the width of the cabinet from side-to-side is greater than the depth of the cabinet, at least in the area of a display (described below).

As will be discussed in more detail below, the cabinet 22 need not have the specific configuration illustrated. It is accordance with the invention, however, it is preferred that the cabinet 22 have a maximum depth of between about 14–18 inches. As will be appreciated, such a depth is much less than that of the standard gaming cabinet, such as in a video gaming device employing a CRT. The reasons such a "thin" cabinet 22 can be provided in accordance with the invention is described in greater detail below.

A door 34 is associated with the cabinet 22 for selectively opening and closing the front 33 of the cabinet 22. Preferably, the door 34 is mounted to the cabinet 22 for movement between a first, open position and a second, closed position. In one or more embodiments, the door 34 is connected to the cabinet 22 with at least one hinge 36. As illustrated in FIG. 2, a single elongate hinge 36 connects the door 34 and the second side 28 of the cabinet 22. Those of skill in the art will appreciate that a variety of means exist for permitting the door 34 to be moved between open and closed positions with respect to the cabinet 22. The door 34 may actually be selectively removable. It will also be appreciated that the door 34 need not be the same size as the front 33 of the cabinet 22. For example, a portion of the front 33 of the cabinet 22 may be enclosed, with the door 34 comprising only a portion of the front 33 thereof.

In its second, closed position, the door 34 cooperates with the cabinet 22 to define a generally enclosed interior portion 38. In its first, open position, the door 34 permits access to the interior portion 38 of the cabinet 22.

The cabinet 22 and door 34 include features which render the device 20 useful for implementing a game. In accordance with the present invention, the cabinet 22 and door 34 are arranged in a "base" configuration or unit which is readily adapted for use in presenting different types of games. In the embodiment illustrated in FIGS. 1–3, the gaming device 20 is configured as a "reel"-type mechanical gaming machine. Such reel or slot- type machines are well known in a variety of specific configurations. As such, much of the details associated with the device 20 as such is common to known slot or reel gaming machines will not be described herein.

In general, the commonly known slot machine has a number of reels with indicia printed thereon. A user of the machine places a wager that when rotated, the reels will stop in such positions that the indicia displayed thereon will comprise a predetermined winning combination. If a predetermined winning combination of indicia is obtained, then the player is paid a payout. As an example, in a common arrangement, a player is declared a winner of the game if the indicia displayed on the reels after they stop rotating all comprise the same indicia.

As illustrated in FIG. 1, means are provided for accepting a wager by a player. In the embodiment illustrated, a coin acceptor 40 and a monetary bill acceptor 42 are provided. The coin acceptor 40 may be associated with a coin hopper (not shown).

As illustrated in FIG. 2, a lower part or portion 44 of the interior is divided or partitioned from the remaining interior space by a panel 45. In accordance with an embodiment of the invention, the coin hopper and a variety of other mechanisms (as described below) may be located in the lower portion 44 of the cabinet 22. The bill acceptor 42 may be associated with a bill validator and stacker (not shown) which may be connected to the door 34 or located in the lower portion 44 of the cabinet 22.

In one or more embodiments of the invention, a player may be paid all or a part of awarded winnings in coins. A coin tray 46 is connected to the cabinet 22 and positioned near the bottom or base 32 thereof. The coin hopper may be arranged to dispense coins in to the tray 46 in the event the player is declared a winner of a particular game. As is known, the player may alternatively be paid with credits, printed slips or to a card or central device/account.

Similar to known slot machines, the device 20 of the present invention includes one or more reels 48. As illustrated, three reels 48 are associated with a reel mechanism 50. Such a mechanism 50 includes an open frame 51, mounts for the reels 48 for permitting rotation of the reels 48, and may include mechanisms for causing the reels 48 to rotate and to stop rotating. Each reel 48 has indicia, such as a variety of symbols associated therewith. The frame 51 may have a variety of configurations. As illustrated, the frame 51 generally includes a number of support plates or members. In other embodiments, the frame 51 may have a configuration more like a housing, being generally enclosed on multiple sides.

A master controller (not shown) is provided for controlling the various components of the device 20 and their functions and is specifically adapted to implementing this type of game. The controller may be arranged to receive an input signal from the coin acceptor/hopper and bill acceptor which indicates that a player has placed the required wager. The controller may then be arranged to display information to the player, such as by illuminating a "spin" button 52. When a player presses the "spin" button 52 or engages another game initiating device, the controller is arranged to cause the reels 48 to spin. The reels 48 may be permitted to freely stop, or the controller may be arranged to generate a signal causing each of the reels 48 to stop in a particular position based on a determined random outcome for the game. In the event the outcome of the game comprises a winning event, then the controller may be arranged to cause coins to be dispensed from the hopper to the coin tray 46.

The controller may also control a number of other mechanisms associated with the device 20, as well known in the art. For example, a candle 54 mounted on the top 30 of the cabinet 22 may be arranged to light in one or more instances. For example, the controller may cause the candle 54 to light if the device 20 requires servicing, or if a winning amount to be paid exceeds that which can be paid from the coin hopper to the user.

Referring to FIG. 1, the gaming device 20 may include a number of other buttons or controls. For example, a "cash-out" button 56 may be used to permit a player to obtain coin payment of any credits placed with the device 20. A "play credits" button 58 may be used to permit a player to play the game with credits obtained or already paid.

The controller may comprise a variety of hardware and/or software. In one embodiment, the processor may comprise a circuit board with associated processor(s). In accordance with the present invention, the controller is preferably arranged to be conveniently located under the panel 45. In such an arrangement, the controller is protected from damage from other components, dust and the like. A mount (not shown) may be provided for removably accepting the control unit, such as a circuit board accepting slot. In other embodiments, the controller may be mounted to the panel 45 or may be mounted to the back 24 of the cabinet 22 (for example, some controllers are arranged to be mounted vertically, and others horizontally). The specific mounting arrangement may be dependent upon the configuration of the controller which a gaming company wishes to install.

In accordance with the present invention, the device 20 is uniquely arranged to facilitate the components for implementing the game. First, the cabinet 22 includes at least one mount for mounting of the reel mechanism 50. Preferably, a first or lower support 62 and a second or upper support 64 are connected to the cabinet 22 for mounting of the reel mechanism 50.

The first support 62 comprises a member, such as a bracket, which extends across at least a portion of the interior space 38 of the cabinet 22. As illustrated, the first support 62 extends from the first side 26 to the second side 28 of the cabinet 22. In the embodiment illustrated, the first support 62 is generally "L"-shaped in cross-section, having a planar top and front surface. As shown, the first support 62 is positioned above the panel 45 which serves to define a top of the lower portion 44 of the cabinet 44.

The second support 64 comprises a member, such as a bracket, which also extends across at least a portion of the interior space 38 of the cabinet 22. As illustrated, the second support 64 extends from the first side 26 to the second side 28 of the cabinet 22, generally parallel to the first support 62. The second support 64 is positioned nearer the top 30 of the cabinet 22 than the first support 62. In one or more embodiments, the second support 64 may be generally "U"-shaped, having vertical sections connected to the first and second sides 26,28 of the cabinet 22 and having a generally horizontal section which extends there between through the interior of the cabinet 22.

Means are provided for mounting the reel mechanism 50 to the supports 62,64. In one or more embodiments, the frame 51 of the reel mechanism 50 is connected to the supports 62,64 with fasteners such as bolts, screws, clips or other means known to those of skill in the art. As illustrated, opposing portions of the frame 51 have projections 53 which extend upwardly for insertion into mating slots (not shown) provided in the upper support 64. During installation, the projections 53 may be inserted into the slots, and then the lower portion of the frame 51 secured to the lower support 62, such as with fasteners.

In one or more embodiments, the first support 62 includes one or more connectors 59. The connectors 59 may comprise electrical connectors for engagement with mating connectors 60 associated with the reel mechanism 50. When connected, the connectors 59,60 provide an electric link from the reel mechanism 50 and the controller.

The first and second supports 62,64 are positioned such that when the reel mechanism 50 is connected to the cabinet 22, at least a portion of each reel 48 is visible through an opening or window 66 in the door 34.

The window 66 comprises an opening in the door 34 extending there through from a front side (facing away from the cabinet 22 when closed) to a rear or back side (facing the cabinet 22 when closed). The window 66 may have a variety of shapes. As illustrated, the window 66 is slightly elongated in the horizontal direction from square.

In accordance with the present invention, a panel 68 is arranged to be selectively mounted over the opening comprising the window 66. The panel 68 may be constructed of glass, plastic or a number of other materials. Preferably, the panel 68 serves to permit a player of the device 20 to see only one or more portions of the interior portion 38 of the device, thus serving a "screening" function. In one or more embodiments, the panel 68 permits a user to see only a portion of each reel 48 located in the device 22.

As illustrated, this "screening" function is a result of the glass or panel 68 having one or more opaque portions 70, and one or more transparent portions 72. In the embodiment illustrated, there are three transparent portions 72 arranged to align with the three reels 48. Of course, if the device 20 were arranged to have four or more reels, the panel 68 could be arranged to have additional transparent portions. It will also be appreciated that the transparent portion may comprise a single elongate area instead of multiple individual areas.

In one or more embodiments, the door 34 is adapted to receive the panel 68. As illustrated, a support 74 is a mounted on the inside of the door 34 below the window 66. Importantly, the support 74 is arranged to support the window glass 68 in a position such that the transparent portions 72 align with that portion of the interior of the cabinet 22 to be viewed, i.e., the reels 48. Other elements may be used in addition to the support 74 for securing the display to the door, as required. In one or more embodiments, the support 74 is connected to a bracket 75. The bracket 75 may be formed as part of the door or be connected thereto. As described below, the bracket 75 is preferably arranged to accept different supports 74.

Figure 3:
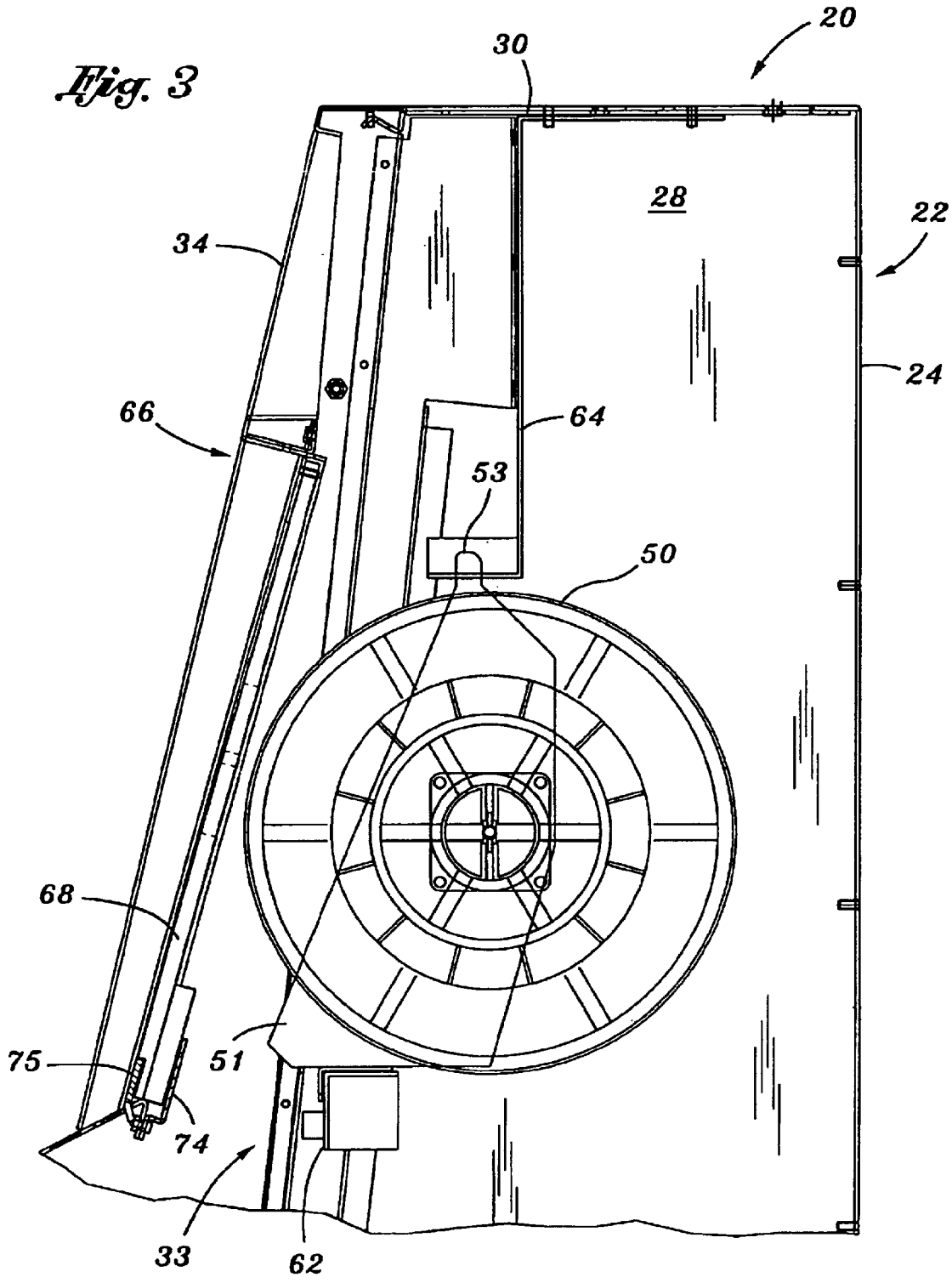
FIG. 3 is a partially assembled cross-sectional side view of the gaming device illustrated in FIG. 1 with only certain components in an interior thereof illustrated.

As configured as illustrated in FIGS. 1–3, the gaming device 20 has a base configuration or unit which is adapted to implement a reel type game. In particular, the base configuration of the device 20 is arranged to accept a reel mechanism 50 having one or more reels 48. In addition, the base configuration or unit is adapted to receive a panel 68 at the window 66 in a position which serves to limit the viewing window of the user to the pertinent portion of each reel.

The gaming device 20 may include a variety of other features and elements. For example, the door 34 may have a lock 76 associated therewith for locking the door into a closed position and preventing access to the interior space 38 of the cabinet 22. One or more vents 80 may be provided in the sides, back or other areas of the cabinet 22 for providing ventilation. A display area 82 may be provided at a top portion of the door 34 above the window 66. The display area 82 may have a panel therein which is backlit with one or more lights from within the cabinet 22, providing an aesthetically pleasing effect.

In use, the gaming device 20 permits play of a reel-type slot game in similar fashion to standard reel-type gaming machine. In one or more embodiments, a player places a bet, such as through the coin or bill acceptors 40,42. The player is then permitted to initiate the spinning of the reels 48, such as by pressing the spin button 56. The player is paid a winning amount if the reels 48 stop in a position in which they display a predetermined combination of indicia or symbols. The winnings may be paid in coins to the coin tray 48. During game play, the player is permitted to view the spinning reels 48 through the transparent portions 72 of the panel 68. When the reels 48 stop, the player is permitted to view the symbols displayed in order to identify whether they are a winner.

Figure 4:
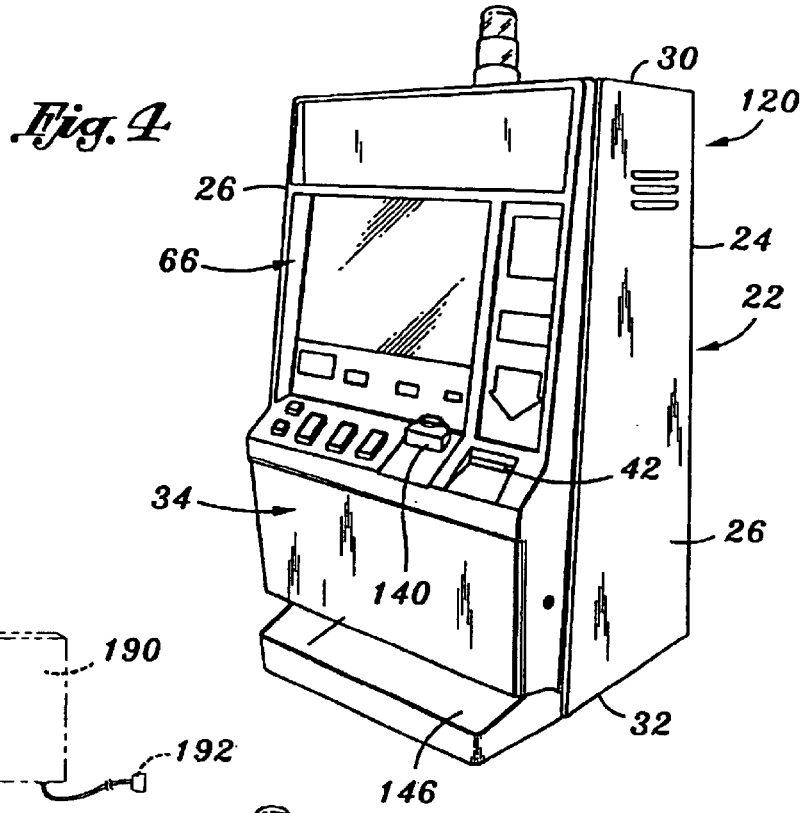
FIG. 4 is a perspective view of the gaming device of the present invention arranged in a second configuration.
Figure 5:
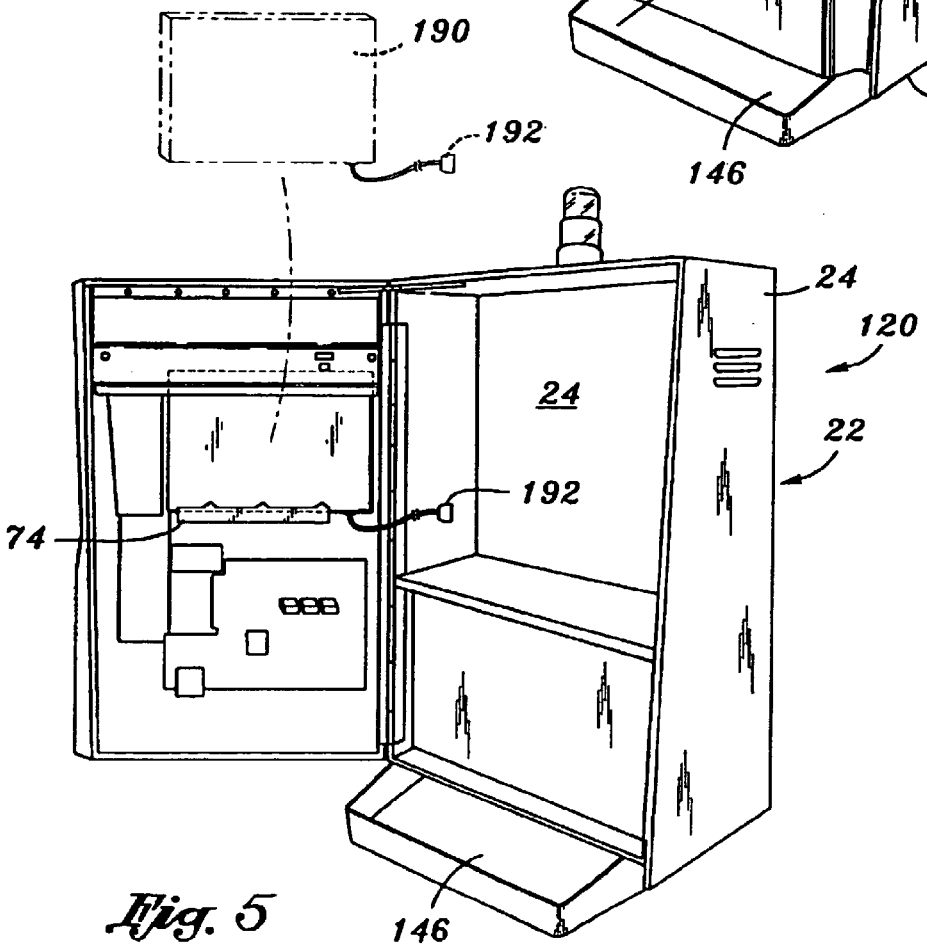
FIG. 5 is a perspective view of the gaming device illustrated in FIG. 4 with a door thereof in an open position and certain components thereof illustrated removed from the device.

Another embodiment of the invention will now be described with reference to FIGS. 4 and 5. Illustrated therein is a gaming device 120 particularly adapted to presenting a video type game. As illustrated, the device 120 is substantially similar to the device 20 illustrated in FIGS. 1–3 and described above. Thus, in the description of this embodiment of the invention, like numerals are given to like parts to those of the previous embodiment.

The gaming device 120 comprises a video gaming device which shares as common features to the reel-type gaming device 20 described above the same general base unit or configuration. Namely, the device 120 comprises a cabinet 22 having a back 24, first and second sides 26,28, a top 30 and a bottom 32. The cabinet 22 preferably has the same shape and dimensions as the cabinet 22 of the previous embodiment.

A door 34 is moveable between a first, open position and a second, closed position. The door 34 is generally the same as the door 34 of the previous embodiment, including a window or opening 66 therein. Importantly, the window 66 is in the same position and has the same shape as the window 66 of the reel-type device.

As with the previous device 20, this device 120 includes a number of components for implementing a game, such as a coin acceptor 40, bill acceptor 42, coin tray 46, and a variety of buttons and/or other controls.

In this embodiment, a different controller (not shown) is used to control the device 120. In particular, a controller is utilized which is adapted to present a different game, such as a video slot or card game, and for displaying associated information on a video screen or display 190.

In a preferred embodiment, the display 190 comprises a liquid crystal display (LCD) screen or other substantially planar or thin display. Another type of thin display comprises a plasma display. Preferably, the display 190 has a thickness or "depth" (i.e. from the front viewing side to a rearmost portion) which is less than 5 inches, and more preferably less than 3 inches. It is also preferred that the display 190 be lightweight. It will be appreciated that such displays do not include current CRT type displays which have depths on the order of 10–20 inches or more and are very heavy.

The display 190 is preferably mounted to the door 34, using a support 74. In one embodiment, the support 74 is the same as the support 74 for the panel 68 in the previous embodiment. Thus, the display 190 is utilized instead, or in replacement of, the panel 58 when configuring the base unit of the device to specifically implement a video game.

In one or more embodiments, the support 74 utilized to connect the display 190 to the door 34 is different from the support 74 utilized to mount the panel 68, but preferably utilizes common mounts. For example, due to differences in the thickness of the panel 58 and display 190, the support for the screen may be deeper. It is preferred, however, that the supports be interchangeable by selective mounting the different supports to the common bracket 75 (see FIG. 3).

The display 190 is sized to display information for viewing through the window 66 in the door 34. The display 190 includes an interface cable 192 for connection to the controller or similar device. It will be appreciated that a clear panel or glass may be placed over the front surface of the display 190, either as attached to the display 190 or to the door 34 for protecting the display from damage. The panel placed over the display 190 may comprise a touch-screen for accepting touch input from a user. Alternatively, it is noted that the display 190 itself may be arranged to accept touch input.

In this embodiment, the reel mechanism 50 is omitted. As such, the supports 62,64 present in the previously described embodiment may or may not be omitted, depending on the desire of the user. For example, a builder of the base unit may always wish to include the reel mechanism supports so that, even if the unit is first configured to implement a video game, the device can readily be converted to a reel game. In one or more embodiments, the supports 62,64 or other supports may be arranged to mount the display 190 in the cabinet for viewing through the window 66.

Use of the device 120 is similar to standard video type gaming devices, depending in part on the specific game which is being implemented. In general, a player is again permitted to place a wager and initiate a game. Data regarding the game is displayed on the display 190. For example, this data may comprise the images of dealt cards for a video poker game, or images of symbols for a video slot game. In the event the player is a winner of the game, the player may be awarded a winning amount.

It will now be appreciated that a gaming device is provided in accordance with the present invention which is capable of being configured simply and easily to present one or more of several different games. The gaming device includes a base configuration or unit arranged to accept either a mechanical reel device and panel for configuring the device as a mechanical "slot" type machine, or an LCD display, for configuring the device as a video type gaming machine.

The gaming device has the advantage that a single base unit can be manufactured simply and cost-efficiently, and yet have multiple uses. A game manufacturer may utilize their specific video and/or game controller along with a display, or a reel-type game controller, reel and panel, to implement a specific gaming device utilizing the base unit. In this manner, the cost of producing these types of gaming devices may be reduced. Because of the configuration of the base unit, either no modifications or insubstantial modifications to the structure are necessary to implement either type of game. It will be appreciated that the "base" configuration of the gaming device of the invention, no matter what game is presented, is the same. As arranged, the window 66 placement and arrangement of the cabinet 22 is such that either the display 190 or a panel 68/reel mechanism 50 combination may be used therewith.

Another advantage of the gaming device of the invention is that the base unit portion thereof is standardized, and thus simpler and easier to repair. The unitary construction reduces the number of parts and knowledge necessary to repair the device, as compared to the varying types of devices utilized to currently offer slot and video type games.

The gaming device of the invention can also advantageously be reconfigured. For example, a particular casino may first obtain the device configured as a slot type machine. Based on consumer demand, the casino may find it desirable to offer a greater number of video type gaming devices. In such event, the gaming device in accordance with the invention can readily be configured by removing the reels, controller and glass, and replacing them with an LCD display and appropriate video game control.

It will now also be appreciated that the configuration of the gaming devices 20,120 of the invention is such that the total size of the device can be reduced substantially as compared to similar devices utilized today. As detailed above, the depth of the cabinet 22 may be reduced from a depth of 20–30 inches or more for present designs, to 14–18 inches (when considering the same portion of each cabinet being compared), a reduction in average depth of 30–40% or more, in accordance with the present invention. As illustrated, this permits the cabinet to have a depth which is less than the width of the cabinet, contrary to the prior art.

Because the gaming device of the invention has such a small size or "footprint," it occupies much less space than previous gaming machines offering similar games. Thus, the number of gaming devices in accordance with the invention which can be provided in a fixed space is higher than compared to conventional devices. This permits a gaming operator to offer more devices, and thus increase income, as compared to today. Alternatively, this arrangement presents a gaming operator the opportunity to offer the same number of devices with remaining space capable of being used for other purposes.

A disadvantage of current gaming devices which employ CRT displays is that these displays generate substantial heat and a large and strong electromagnetic field. Because of the heat and magnetic field which is generated, the cabinets must be large to permit other components to be located remote from the CRT. Fans and other devices are generally used to improve ventilation in these devices, adding to their energy use and complexity. An advantage of the gaming device 120 having an LCD or similar display is that heat generation is greatly reduced. Thus, the design of the cabinet is not driven by ventilation requirements, but by aesthetics and other factors. Not only can the cabinet be much smaller because of the reduced space occupied by the display, but other components can be located close to the display because it does not generate substantial heat. In addition, the problems with electromagnetic fields are not existent with the LCD and other similar types of displays, permitting other electrical components to be placed close thereto.

LCD and similar displays also have several other advantages over CRT type displays. As will be appreciated, it is common for a video game to display a basic menu or symbols associated with one type of game. Because the menu and symbols are displayed for extended periods of time, these images are "burned in" to the screen. When other images are displayed, a shadow image of the base menu or symbols remains on the screen. This is distracting to the player and makes it difficult for the player to see other displayed information. CRT type displays "refresh" the images by re-displaying them multiple times per second. This refresh can generate a visible flicker which causes strain to the eyes of a viewer. LCD, plasma and similar displays avoid these problems.

Advantageous are also realized by connecting the video display to the door of the gaming device. In particular, because the display is connected to the door, no supports are needed in the cabinet for the display, freeing up substantial space within the cabinet 22 for other components, such as circuitry and the like. Also, when the door is moved to its open position, the display is moved out of the interior of the cabinet, making the interior portion of the cabinet more accessible. The attachment of the display to the door also renders the display more readily accessible for servicing or removal.

While the gaming device of the present invention has been described specifically as used to implement two different types of games, those of skill in the art will appreciate that there are a variety of other games which may be implemented utilizing the device.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A gaming apparatus configured to present one or more wager-based games comprising a cabinet, a door connected to said cabinet, said door moveable between a first position and a second position, said door in said first position cooperating with said cabinet to define a generally closed interior space, said door in said second position permitting access to said interior space, said door having an inner surface and an outer surface and an opening therein, a generally planar video display mounted to said inner surface of said door and movable with said door when said door is moved between said first and second positions, said video display aligned with said opening in said door to be viewable therethrough, and at least one gaming controller, said gaming controller located in said interior space and connected to said video display to provide game information for display by said video display.

2. The gaming apparatus in accordance with claim 1 wherein a mount is connected to said door and said video display is supported by said mount.

3. The gaming apparatus in accordance with claim 1 wherein generally planar video display comprises an LCD display.

4. The gaming apparatus in accordance with claim 1 wherein said cabinet has a front and a back and has a reduced dimension from said front to said back.

5. The gaming apparatus in accordance with claim 1 wherein said door is located at a front of said cabinet, said door in said first position comprising said front of said cabinet.

6. The gaming apparatus in accordance with claim 1 wherein a plurality of player input buttons are mounted to said door and located at said outer surface thereof.

7. The gaming apparatus in accordance with claim 1 wherein said opening is located below a display area in said door at a top portion thereof.

8. A gaming apparatus having a reduced depth dimension and configured to present one or more wager-based games comprises a cabinet having a first side, a second side, a front and a back, said cabinet having a width from said first side to said second side which exceeds a depth of said cabinet from said front to said back, a door connected to said cabinet, said door moveable between a first position and a second position, said door in said first position cooperating with said cabinet to enclose at least a portion of said front of said cabinet and define a generally closed interior space, said door in said second position permitting access to said interior space through said front of said cabinet, said door having an inner surface and an outer surface and an opening therein, a generally planar video display mounted to said inner surface of said door and movable with said door when said door is moved between said first and second positions, said video display aligned with said opening in said door to be viewable therethrough, and at least one gaming controller, said gaming controller located in said interior space and connected to said video display to provide game information for display by said video display.

9. The gaming apparatus in accordance with claim 8 including a bracket connected to said door support connected to said bracket, said support defining a generally horizontal supporting surface upon which a lower edge of said video display is supported when connected to said door.

10. The gaming apparatus in accordance with claim 8 wherein said video display is a LCD display.

11. The gaming apparatus in accordance with claim 8 wherein said video display is a plasma display.

12. The gaming apparatus in accordance with claim 8 wherein said door is located at a front of said cabinet, said door in said first position comprising said front of said cabinet.

13. The gaming apparatus in accordance with claim 8 wherein a plurality of player input buttons are mounted to said door and located at said outer surface thereof.

14. The gaming apparatus in accordance with claim 8 wherein said opening is located below a display area in said door at a top portion thereof.

* * * * *